United States Patent [19]

Drews et al.

[11] 4,249,498

[45] Feb. 10, 1981

[54] APPARATUS FOR CORRECTING A FUEL APPORTIONMENT SIGNAL IN AN INTERNAL COMBUSTION ENGINE

[75] Inventors: Ulrich Drews, Vaihingen-Pulverdingen; Hans Schnürle, Walheim; Michael Horbelt, Schwieberdingen, all of Fed. Rep. of Germany

[73] Assignee: Robert Bosch GmbH, Stuttgart, Fed. Rep. of Germany

[21] Appl. No.: 24,490

[22] Filed: Mar. 27, 1979

[30] Foreign Application Priority Data

Apr. 7, 1978 [DE] Fed. Rep. of Germany ..... 2815067

[51] Int. Cl.[3] ..... F02B 3/00

[52] U.S. Cl. ..... 123/478; 123/492

[58] Field of Search ..... 123/32 EA, 32 AE, 32 ED, 123/32 EL, 32 EH

[56] References Cited

U.S. PATENT DOCUMENTS

| | | | |
|---|---|---|---|
| 3,946,704 | 3/1976 | Monpetit | 123/32 EA |
| 4,015,563 | 4/1977 | Drews et al. | 123/32 ED |
| 4,089,313 | 5/1978 | Asano et al. | 123/32 EH |
| 4,092,955 | 6/1978 | Reddy | 123/32 EA |
| 4,153,013 | 5/1979 | Bianchi et al. | 123/32 EA |

*Primary Examiner*—P. S. Lall

*Attorney, Agent, or Firm*—Edwin E. Greigg

[57] ABSTRACT

Apparatus for correcting the fuel apportionment signal in an internal combustion engine during an alteration in quantity of the fuel which includes a first storage device charged according to the rpm, the storage value of which determines the content of a second storage device in accordance with certain time intervals and according to a specific function and the alteration signal of the second storage device is used for the correction of the fuel apportionment signal.

8 Claims, 10 Drawing Figures

J
tpmax
Uc2
Uc3
iKorr
tp

APPARATUS FOR CORRECTING A FUEL APPORTIONMENT SIGNAL IN AN INTERNAL COMBUSTION ENGINE

BACKGROUND OF THE INVENTION

Anti-jerk devices are presently available for a fuel injection internal combustion engine. The injection time in such a well-known injection system is determined by the discharge time of a capacitor whose charging depends on the rpm and whose discharging depends on the load. In order to implement the anti-jerk mechanism of such a known device, the charging process proceeds in two phases in which, during a first phase, the charging occurs relatively fast up to a certain signal level and then it levels off. In this way, sudden changes in the rpm do not cause large differences in the amount of fuel injected and torque fluctuations are thus prevented. It has become evident that this well-known anti-jerk device does not work satisfactorily since, in the actual anti-jerk device, only an rmp signal is used. Therefore optimum driving comfort is not achieved. In regard to optimum acceleration of the internal combustion engine, the limitation of the alteration should also be dependent on the existing load.

OBJECT AND SUMMARY OF THE INVENTION

The object of the invention is to provide a device which overcomes the shortcomings of the prior art so that, consequently, an optimum operating condition of an internal combustion engine is assured.

Especially advantageous is the concept that the time interval for the signal change of the second storage device is dependent on the load, since the driver of a vehicle does not perceive certain changes in torque of the engine as equally disturbing under all load conditions. Furthermore, it has proven expedient for the functions in accordance with which the signal changes of the second storage device occur to depend on the direction of alteration. In this way an extremely quiet operation of the internal combustion engine is achieved, for example, during overrunning. On the other hand, torque increases in case of acceleration can be adapted to a level intended for maximum acceleration and still be perceived as satisfactory by the driver.

A correction signal for the fuel is generated from the adaptation signal of the second storage device to a continually current value so that the adaptation takes place only during certain intervals and these intervals are constant or dependent, for example, on the load. Thus, an anti-jerk device is provided because large changes of the fuel apportionment and therefore torque fluctuations are prevented through a limitation of the possible changes of the fuel apportionment signals, and it is also an advantage to have the value adaptation of the second storage device dependent with respect to its function on the direction of adaptation, i.e., to higher or to lower values.

The invention will be better understood as well as further object and advantages thereof become more apparent from the ensuing detailed description of exemplary embodiments taken in conjunction with the drawings.

DESCRIPTION OF THE PREFERRED EMBODIMENT

Figure 1:
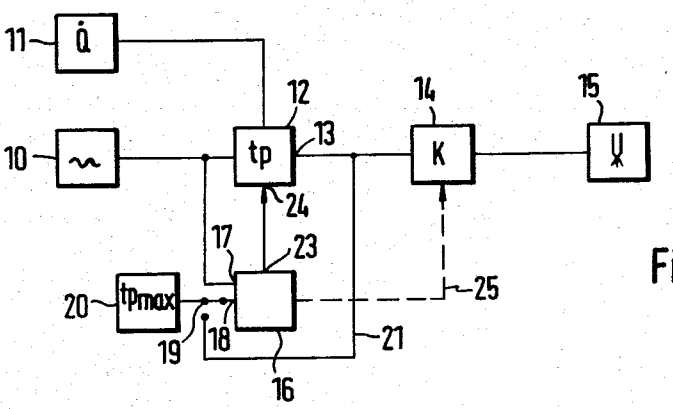
FIG. 1 shows a block diagram of a fuel injection system with the proposed circuit of the invention for correcting the fuel apportionment signal.

Referring now to FIG. 1, there is shown a schematic block diagram of a fuel injection system for an internal combustion engine which includes a device for correcting the fuel apportionment signal during a change in quantity. In FIG. 1, there is shown an rpm transducer 10 and an air flow rate meter 11 for determining the load. The output signals of both sensors 10 and 11 are fed to a pulse generator 12 having an output 13 connected to a correction stage 14. The output from the correction state 14 in turn furnishes the control signal for the electromagnetic injection valves 15 in the engine.

Referring now to FIG. 1, there is shown the device 16 for correcting the fuel apportionment signal itself. Device 16 is provided with an input 17 for an rpm signal and also an input 18 for a time signal. If this time signal must have a constant value, it is connected with a time element 20 across a schematically indicated alternating switch 19. In the event the time interval is also to be dependent on the load, the input 18 is connected to the output line 13 of a pulse generator 12 across the alternating switch 19 and a line 21. The present illustration of the alternating switch 19 has been selected in order to indicate at least these two alternative possibilities of interval determination. It is a question of efficiency as to which kind of time interval (constant or variable) is selected, and accordingly, the alternating switch 19, shown in FIG. 1, is best accomplished by a solid line of direct wiring.

A first output 23 of the device 16 is connected additionally with an input 24 of the pulse generator 12 in order to exert direct influence on the pulse generator 12. Another possibility of pulse width control exists via the correction stage 14, and this possibility requires a connection 25 between device 16 and the correction stage 14. Fundamentally, however, there is no difference between the two possibilities. The purpose of both circuits is to limit the change between two successive injection signals for the injection valve 15 to an optimum value.

Figure 2:
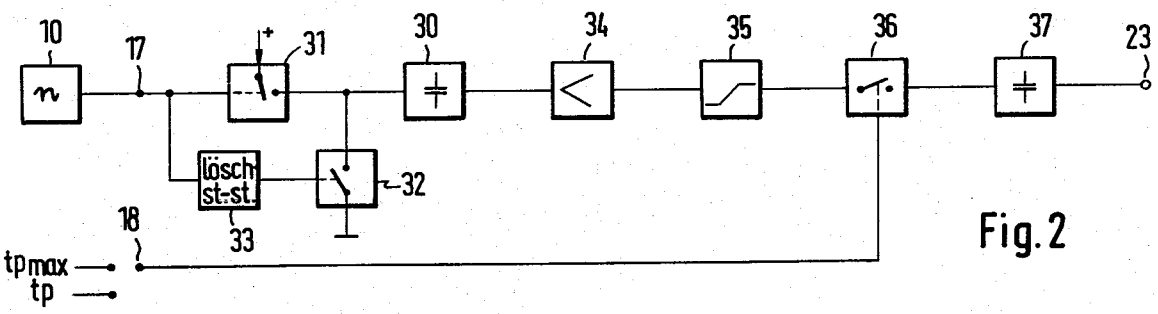
FIG. 2 is a block diagram of the circuit incorporated in FIG. 2.

FIG. 2 shows a block diagram of the device 16 of FIG. 1. It contains a first storage device 30 which can be charged from an energy source through a switch 31 and discharged through a switch 32. Both the charging and the discharging of the storage device 30 are controlled on the basis of an rpm signal which is present at the input 17. A discharge control stage 33 is located before the switch 32 for the purpose of briefly discharging the storage device 30. The signal from the storage device 30 is amplified by means of an amplifier 34, the value of which is limited by a limiting switch 35, and during certain intervals is transmitted to a second storage device 37 through a switch 36. From the output 23, the alteration signal of the storage device 37 can be picked up, which serves to control the fuel quantity change. This alteration signal can be produced, for example, by means of a differentiation unit which, if necessary, also includes the storage device 37. The switch 36 receives its control signal from input 18 of device 16, to which, by choice, a signal of constant value or else, for example, a value dependent on the duration of the load can be applied.

Figure 3:
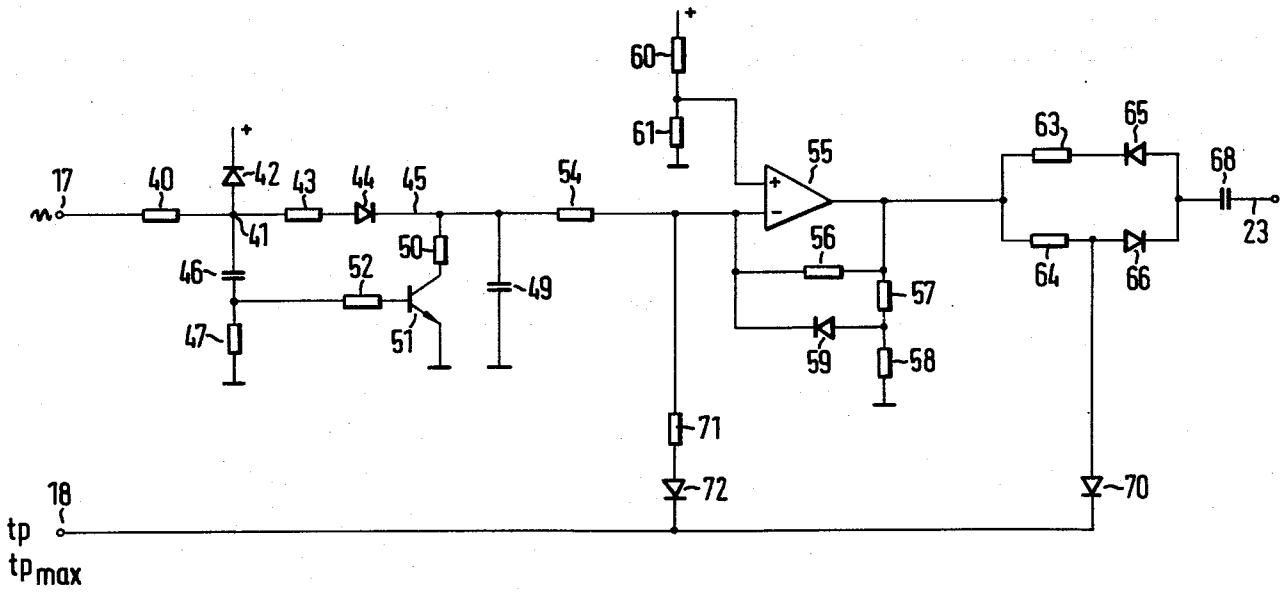
FIG. 3 is a detailed schematic diagram of this circuit of FIG. 2.

FIG. 3 shows a detailed diagram of the circuit shown in FIG. 2. An rpm signal applied to the input 17 is fed through a resistor 40, the other side of which is connected to a connection point 41. This connection point 41 is connected through a diode 42 with the positive side of an energy source (not shown) and over a series connection of a resistor 43 and a diode 44 to a connecting line 45 and finally through a series connected capacitor 46 and a resistor 47 connected to ground.

Between the connecting line 45 and ground, there is provided a capacitor 49 forming the first storage device 30 of FIG. 2, and there is also a series connection of a resistor 50 and a transistor 51. The base of transistor 51 is connected through a resistor 52 with the connection point of a capacitor 46 and a resistor 47. Connection line 45 is also connected through a resistor 54 to the inverting input of an amplifier 55 provided with a feedback circuit in the form of a diode-resistor combination.

The feedback current for amplifier 55 includes a resistor 56 which lies within the feedback circuit. The output of amplifier 55 is connected to ground through two resistors 57 and 58, the connection point of the two resistors 57, 58 being connected with the inverting input of the amplifier 55 through a diode 59. The non-inverting input of the amplifier 55 is connected to a voltage supply at the junction of a voltage divider consisting of two resistors 60, 61.

A parallel circuit of two diode-resistor series is connected to the output of the amplifier 55, the diodes 65, 65, which are connected in series with the resistors 63, 64 respectively, being oppositely poled and connected to a capacitor 68 at the connection of the diodes 65, 66 remote from the resistors 63, 64. The other side of capacitor 68 is connected to the output 23 of the device. The connection point of resistor 64 and diode 66, whose anode points toward the resistor 64, is connected through a diode 70 with the input 18 of the device. Also connected to the input 18 is the inverting input of the amplifier 55 through a series connected resistor 71 and diode 72.

Figures 4A, 4B, 4C, 4D, 4E, 4F, 4G:
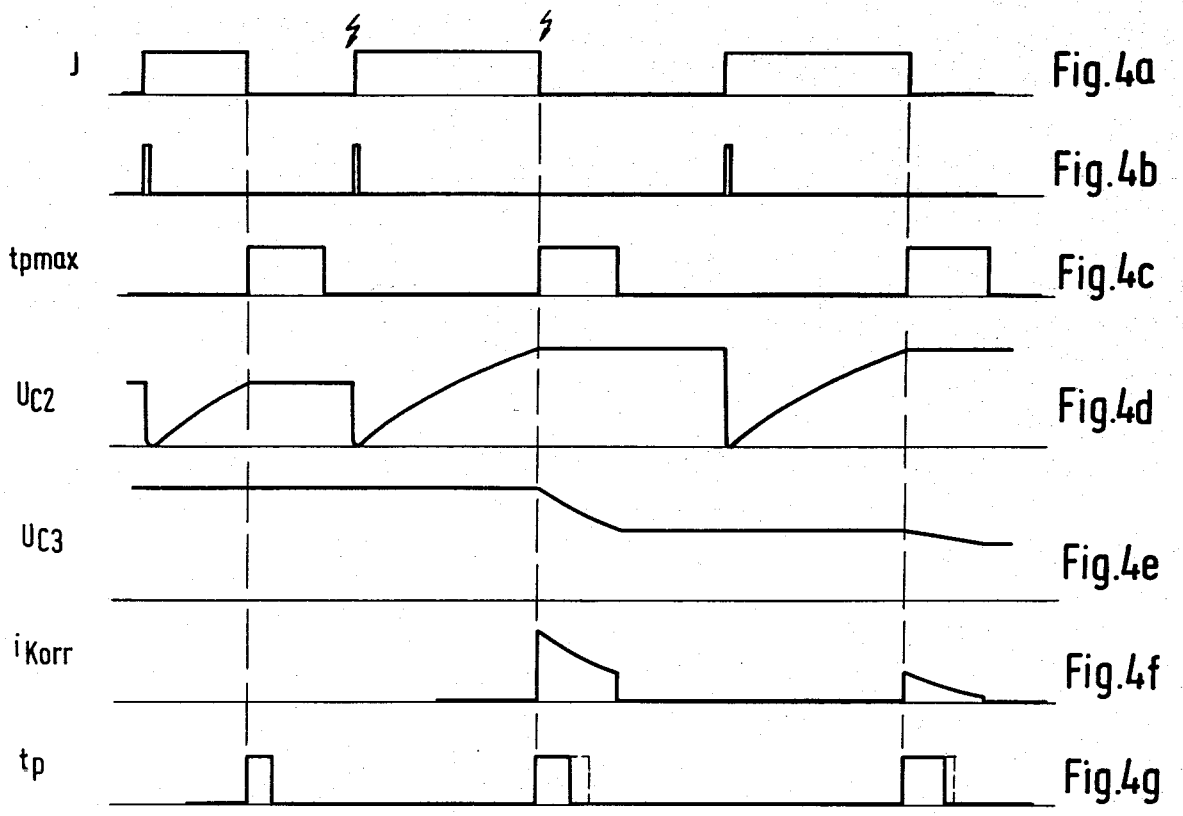
FIGS. 4*a*–4*g* are various pulse diagrams pertaining to the circuit of FIG. 3.

The circuit arrangement of FIG. 3 is explained more appropriately by reference to the pulse diagram shown in FIG. 4. FIG. 4*a* shows the rpm signal appearing at the input 17 of the device 16, wherein the edges appear at the moment of ignition. In FIG. 4*b*, the basic signal of transistor 51 is presented in a simplified manner. However, it is apparent that the discharge signal for the capacitor 49 appears with every leading edge of the signal shown in FIG. 4*a*, and it has to last long enough so that capacitor 49 is regularly completely discharged.

FIG. 4*c* shows the time signal on the input 18 of the device. It is phase-shifted such that the signal appears with every trailing edge of the signal shown in FIG. 4*a* and continues for a certain length of time which can be either constant or dependent on load according to the above-mentioned system. FIG. 4*d* shows the signal across the capacitor 49. One can see the discharging of the capacitor 49 during a discharge pulse shown in FIG. 4*b* and a following phase of charging during the pulse duration of the signal shown in FIG. 4*a*. The level of capacitor voltage reached at the moment when the trailing edge of the rpm transducer output signal appears is maintained until the next discharging cycle and it conforms to the duration of charging.

FIG. 4*e* shows the voltage across the capacitor 68 located at the output 23 of the device 16. From FIG. 4*e*, it can be seen that the level of this signal remains constant with a constant rpm and changes only when the rpm transducer output signal changes. A change of the signal occurs only during the time intervals shown in FIG. 4*c*, while the kind of change, i.e., the function of the adaptation process to the new voltage rate, follows a mathematical function which can be determined. This may be seen in the diagram of FIG. 4*f*. On the basis of the circuits used, along with the resistors 63 and 64 and the capacitor 68, an e-function is obtained for the current which flows either towards the capacitor 68 or away from it. The adaptation is therefore carried out over many cycles. The current signal shown in FIG. 4*f* serves to correct the injection signal either in the pulse generator 12 or in the correction stage 14 of FIG. 1. Therefore, the level of the correction current shown in FIG. 4*f* determines the extent of the adaptation of the generated injection signals.

The circuit shown in FIG. 3 functions as follows: As long as the input potential on input 17 of the device 16 is zero, the diodes 42, 44 are blocked as well as the transistor 51, and therefore the capacitor 49 can not discharge, at least not toward the charging side. Immediately after the trailing edge of the rpm transducer signal according to FIG. 4*a*, the time signal as shown in FIG. 4*c* arrives at the input 18 and thus also blocks the diode 72 and the diode 70. Because of this, the signal is transmitted across the capacitor 49 and through the amplifier 55 to the capacitor 68, whereby a charging or discharging current flows towards or away from the capacitor 68, depending on whether the output signal of the amplifier 55 assumes a higher or a lower value than before. Also dependent on this direction of the current, one of the two resistors 63 and 64 has current flowing therethrough. Thus, the time constant for the discharging and charging process is determined by the value of these resistors 63 and 64.

After a pulse duration has elapsed according to FIG. 4*c*, the potential at input 18 returns to zero and also reduces to zero the potential at the inverting input of the amplifier 55 as well as the anode potential of diode 66. As a result, the output voltage of the amplifier 55 increases and the diode 65 blocks. Diode 66 also lies in blocking position since its anode potential is lowered through diode 70. As a result, the charging condition and therefore the voltage across capacitor 68 remains constant after the expiration of the pulse duration of the signal shown in FIG. 4*c*. A new change in this charging state is only possible when the time signal appears again at the input 18 because then diode 66 is activated by current directly and diode 65 indirectly through the amplifier 55 so that a compensatory current can flow towards or away from capacitor 68.

The compensatory current appearing at output 23 now regulates, in a well-known pulse generator, the pulse duration of the injection pulse which has been generated. Since the current at the output 23 appears only while the pulse of the signal prevails, as shown in FIG. 4*c*, it becomes clear that the degree of adaptation of the injection pulses to a new rpm can also be made variable by regulating the pulse duration of this signal according to the load. As mentioned above, this pulse duration according to FIG. 4*c* should be chosen appropriately depending on the load. Thus it becomes possible to tune the adaptation of the injection pulses to new rpm conditions in an optimum way to the actual load conditions of the engine and thus to achieve an optimum driving operation.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. Apparatus for correcting a fuel apportionment signal in an internal combustion engine during a change in quantity comprising, in combination, a first storage device, means for charging said first storage device in accordance with rpm to provide a stored value, a second storage device for providing a periodic alteration signal, means including said stored value for determining the content of said second storage device during certain time intervals and according to a certain function and means including the alteration signal of said second storage device for correcting the fuel apportionment signal.

2. Apparatus in accordance with claim 1 wherein the time interval for the signal change of said second storage device is held constant or depends on operating characteristics.

3. Apparatus in accordance with claim 2 wherein the time interval for the signal change of said second storage device is at least dependent on the rpm and/or on the load.

4. Apparatus in accordance with claim 1 wherein the function of the signal change of the second storage device is different depending on the direction of the change.

5. Apparatus in accordance with claim 4 wherein an exponential function is provided as the function of the signal change of said second storage device.

6. Apparatus in accordance with claim 5 wherein the charging of said first storage device is repeated after certain edges of the rpm transducer signal and follows an exponential function.

7. Apparatus in accordance with claim 6 including a pulse generator, a correction unit for the injection pulse and means for feeding the change signal of said second storage device to said pulse generator and/or to said correction unit for the injection pulse.

8. Apparatus for correcting a fuel apportionment signal in an internal combustion engine during a change in required fuel quantity including:

a first electrical storage device;

a first means for charging the first electrical storage device in accordance with engine rpm pulses;

a second electrical storage device having a charge to provide an alteration signal;

a second means for charging the second electrical storage device in accordance with engine rpm pulses;

wherein the alteration signal is dependent on the charge of the first electrical storage device during predetermined time intervals and according to pre-determined functions;

and further wherein the pulses of the first charging means are phase-shifted with respect to the pulses of the second charging means.

* * * * *